US010164393B2

(12) United States Patent
Usuelli

(10) Patent No.: US 10,164,393 B2
(45) Date of Patent: Dec. 25, 2018

(54) ASSEMBLY FOR RECEIVING A PLUG OF AN ELECTRICAL BAYONET CONNECTOR

(71) Applicant: ATLAS COPCO BLM S.R.L., Paderno Dugnano (MI) (IT)

(72) Inventor: Massimo Usuelli, Cinisello Balsamo (MI) (IT)

(73) Assignee: ATLAS COPCO BLM S.R.L., Paderno Dugnano (MI) (IT)

( * ) Notice: Subject to any disclaimer, the term of this patent is extended or adjusted under 35 U.S.C. 154(b) by 330 days.

(21) Appl. No.: 14/779,901

(22) PCT Filed: Mar. 24, 2014

(86) PCT No.: PCT/IB2014/060097

§ 371 (c)(1),
(2) Date: Sep. 24, 2015

(87) PCT Pub. No.: WO2014/155274

PCT Pub. Date: Oct. 2, 2014

(65) Prior Publication Data

US 2016/0049764 A1 Feb. 18, 2016

(30) Foreign Application Priority Data

Mar. 29, 2013 (IT) ..... MI2013A0496

(51) Int. Cl.
*H01R 13/62* (2006.01)
*H01R 43/16* (2006.01)
(Continued)

(52) U.S. Cl.
CPC ..... *H01R 43/16* (2013.01); *H01R 13/625* (2013.01); *H01R 13/629* (2013.01); *H01R 13/74* (2013.01); *H01R 43/26* (2013.01)

(58) Field of Classification Search
CPC .... H01R 13/625; H01R 13/629; H01R 13/74; H01R 43/16; H01R 43/26
See application file for complete search history.

(56) References Cited

U.S. PATENT DOCUMENTS 6,336,822 B1 1/2002 Luzzoli
6,802,725 B2 * 10/2004 Rowland ..... H01R 13/5213 439/144

(Continued)

FOREIGN PATENT DOCUMENTS

FR 2678440 A1 12/1992

OTHER PUBLICATIONS

English Abstract FR 2678440 A1 dated Dec. 31, 1992.
International Search Report dated Jul. 3, 2014.

*Primary Examiner* — Minh Trinh
(74) *Attorney, Agent, or Firm* — Hedman & Costigan, P.C.; James V. Costigan; Kathleen A. Costigan

(57) ABSTRACT

A mounting assembly (100) for mounting a plug (10) of a bayonet circular connector, the plug (10) having a circular core (11) which supports a plurality of electric contacts (12) engageable with corresponding complementary electric contacts of a receptacle (13) of the bayonet circular connector and a bayonet blocking ring (14) which is mounted in a rotating manner on the core (11) and which is suitable for cooperating with blocking elements (15) arranged in the receptacle (13) in the mounting assembly (100). A tubular body (16) for supporting the core (11) is provided where the tubular body (16) is insertable in an opening (17) of a panel (18) or a wall, with fixing means for fixing the tubular body (16) to the panel (18) or to the wall, and maneuvering means (19) for maneuvering the bayonet blocking ring (14).

7 Claims, 6 Drawing Sheets

(51) Int. Cl.

| | |
|---|---|
| ***H01R 13/625*** | (2006.01) |
| ***H01R 13/74*** | (2006.01) |
| ***H01R 43/26*** | (2006.01) |
| ***H01R 13/629*** | (2006.01) |

(56) References Cited

U.S. PATENT DOCUMENTS

| | | | | |
|---|---|---|---|---|
| 7,575,450 | B2 * | 8/2009 | Williams | H01R 13/5219 439/144 |
| 7,837,491 | B2 * | 11/2010 | Collin | H01R 13/62966 439/317 |
| 8,177,575 | B2 * | 5/2012 | Katagiyama | H01R 13/625 439/345 |
| 9,056,536 | B2 * | 6/2015 | Bartoli | H01R 13/502 |
| 9,502,824 | B2 * | 11/2016 | Jordan | H01R 13/629 |
| 2016/0049764 | A1 * | 2/2016 | Usuelli | H01R 13/625 29/747 |

* cited by examiner

ASSEMBLY FOR RECEIVING A PLUG OF AN ELECTRICAL BAYONET CONNECTOR

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISK OR AS A TEXT FILES VIA THE OFFICE ELECTRONIC FILING SYSTEM (EFS-WEB)

Not Applicable

STATEMENT REGARDING PRIOR DISCLOSURES BY THE INVENTOR OR A JOINT INVENTOR

Not Applicable

(1) Field of the Invention

The present invention refers to a mounting assembly for mounting a plug of a bayonet circular connector on a panel or on a wall, in particular a panel or a wall of a containment box-shaped body for containing an electric or electronic device.

(2) Description of Related Art including information disclosed under 37 CFR § 1.97 and 1.98

The present invention refers, moreover, to a mounting arrangement of a plug of a bayonet circular connector on a panel or on a wall, in particular a panel or a wall of a containment box-shaped body of an electric or electronic device, using such a mounting assembly.

Bayonet circular connectors, also known in the jargon of the field as "military connectors" or "connectors of the military type", are plug and receptacle engagements for the transmission and distribution of energy, in particular electric energy, which have been known for a long time and are used in different industrial fields for their characteristics of safety and strength also in critical working conditions and environments.

The bayonet circular connectors are used, in particular, in the field of the car industry for example to connect electric-electronic measuring devices—such as rotation sensors or torque/force measuring devices like that which is applied, for example, when locking threaded joints—to remote electronic units for processing and controlling the data they have detected.

It is known to mount the receptacle of bayonet circular connectors directly onto panels or walls by means of connecting flanges.

It is, therefore, known to mount the receptacle of bayonet circular connectors directly on the casing containing the electric-electronic measuring devices.

To this day, the plug of bayonet circular connectors is, on the other hand, mounted at the end of a transmission cable, the opposite end of which can be connected to a source of electric energy or to a user device.

In some applications, however, the connection through cable can generate some problems.

In applications of the type for example of that indicated above, due to the length of the cables, errors in the detected measuring data can be generated or, due to the continuous manipulation of the electric-electronic measuring devices, weakenings and discontinuities can be generated in the connection joint between the cable and the plug with the consequent need of frequently replacing the joint and the entire cable.

The purpose of the present invention is that of avoiding the drawbacks of the prior art.

In this general purpose, one particular purpose of the present invention is that of providing a mounting assembly that makes it possible to mount a plug of a bayonet circular connector directly on a panel or a wall, in particular a panel or a wall of a containment box-shaped body of an electric or electronic device, in a simple, safe and easily manoeuvrable and controllable manner by a user.

Another purpose of the present invention is that of providing a mounting arrangement of a plug of a bayonet circular connector on a panel or a wall, in particular a panel or a wall of a containment box-shaped body of an electric or electronic device, which is particularly simple and safe and that makes it possible to directly connect two containment box-shaped bodies, for containing respective electric-electronic modules, to one another.

BRIEF SUMMARY OF THE INVENTION

These purposes according to the present invention are achieved by making a mounting assembly of a plug of a bayonet circular connector according to an embodiment.

These purposes according to the present invention are achieved by making a mounting arrangement of a plug of a bayonet circular connector on a panel or a wall, in particular a panel or a wall of a containment box-shaped body of an electric or electronic device, according to another embodiment.

Further characteristics are provided in the following detailed description.

BRIEF DESCRIPTION OF THE SEVERAL VIEWS OF THE DRAWINGS

The characteristics and the advantages of a mounting assembly of a plug of a bayonet circular connector and of a mounting arrangement of a plug of a bayonet circular connector on a panel or a wall, in particular a panel or a wall of a containment box-shaped body of an electric or electronic device, according to the present invention shall become evident from the following description, given as an example and not for limiting purposes, with reference to the attached schematic drawings, in which.

DETAILED DESCRIPTION OF THE INVENTION

Figure 1:
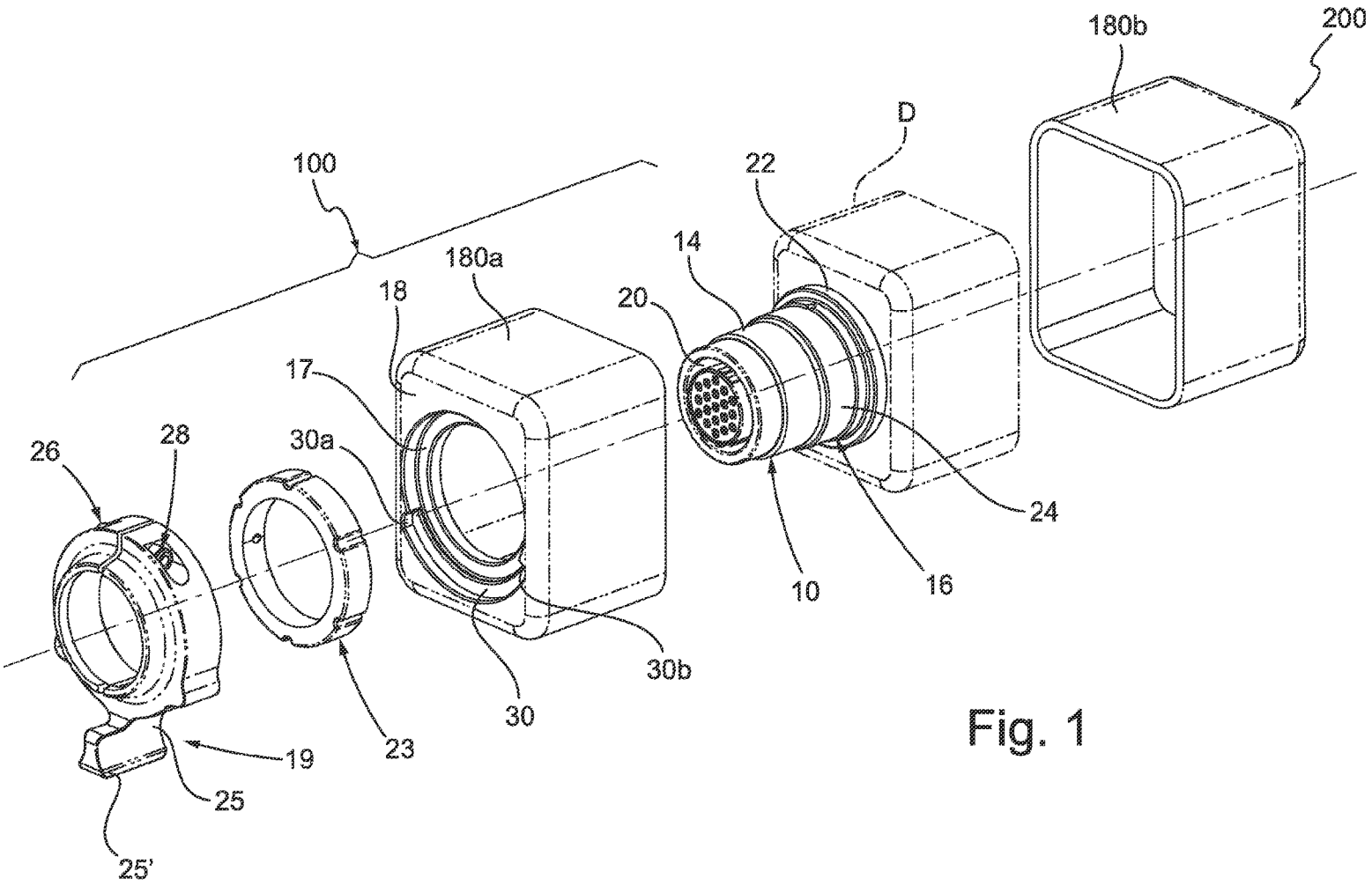
FIG. 1 is a partially exploded schematic view of a mounting arrangement of a plug of a bayonet circular connector on a wall of a box-shaped body with a mounting assembly according to the present invention.
Figure 2:
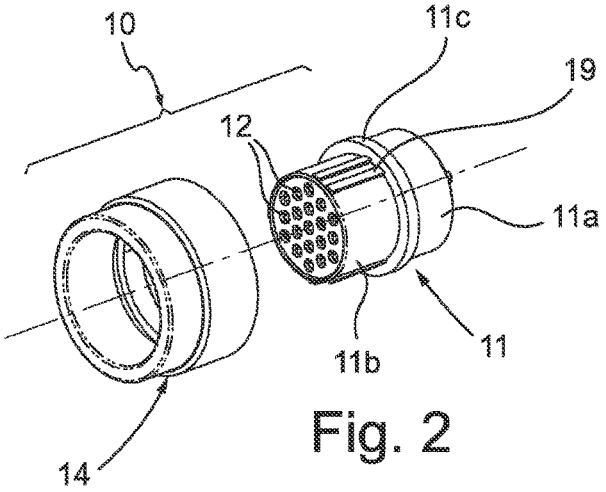
FIG. 2 is an exploded view of the plug of a bayonet circular connector according to the present invention.
Figure 3:
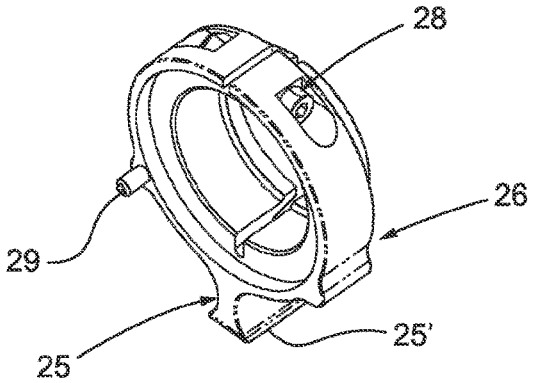
FIG. 3 is an axonometric rear view of the manoeuvring ring of the bayonet blocking ring of a plug of a bayonet circular connector belonging to the mounting assembly according to the present invention.

With reference to the attached figures, reference numeral 100 wholly indicates a mounting assembly of a plug 10 of a bayonet circular connector.

By "bayonet circular connector" it is meant to indicate a plug and receptacle connector for the transmission and distribution of energy, in particular electric energy, known in the jargon of the field as "military connector" and in which the plug and the receptacle are kept firmly connected to one another through a bayonet engagement that is per se known and that, therefore, shall not be described in further detail in the rest of the description except for where it helps the present invention to be understood.

In general, the bayonet engagement comprises a blocking ring or bayonet ring which is mounted in a rotating manner on the core of the plug and in which recesses are obtained; blocking elements obtained in the receptacle and which, for example, are made of pins that extend radially from the outer lateral surface of the receptacle itself, engage with said recesses.

The plug 10 comprises a circular core 11 which supports a plurality of electric contacts 12 which can be engaged with corresponding complementary electric contacts, not shown, of a receptacle 13. The number and the arrangement of the electric contacts 12 can be different from those shown in the attached figures and do not limit the present invention.

A bayonet blocking ring 14 is mounted in a rotating manner on the core 11, said blocking ring 14 being suitable for cooperating, in a known manner, with the blocking elements 15 provided on the receptacle 13. In particular, in the bayonet blocking ring 14 there are recesses, which are not represented since they are of the known type, suitable for cooperating with the blocking elements 15 which, for example, are made up of pins which extend radially from the outer lateral surface of the receptacle 13.

The core 11 and the bayonet blocking ring 14 form an assembly that defines the plug 10 in the strictest sense and that, as such, is already available on the market.

The mounting assembly 100 of the plug 10 comprises:

- a tubular body 16 which supports the core 11 in a fixed manner and which is insertable in an opening 17 of a panel 18 or a wall, in particular a panel 18 or a wall of a containment box-shaped body of an electric or electronic device,
- fixing means for fixing the tubular body 16 to the panel 18 and
- manoeuvring means 19 for manoeuvring the bayonet blocking ring 14 and which are integrally associated with the bayonet blocking ring 14 itself.

In greater detail, the core 11 comprises a first section 11*a* and a second section 11*b* between which a collar 11*c* is defined which protrudes from their outer lateral surface.

A threading, which is not shown for the sake of simplifying the representation, is defined on the outer lateral surface of the first section 11*a*.

The bayonet blocking ring 14 is mounted in a rotating manner on the second section 11*b* of the core 11 and between them a gap 20 is defined for coupling with the plug 13. The assembly of the bayonet blocking ring 14 on the second section 11*b* of the core 11 is of the type known by a man skilled in the art and is not described here in further detail.

Grooves 19 for guiding the engagement with the receptacle 13 are obtained on the outer lateral surface of the second section 11*b*.

The tubular body 16 is open at the opposite ends and has, at a first of such two opposite ends, a seat 21 which is internally threaded (and the threading of which is not shown for the sake of simplifying the representation) and in which the first section 11*a* of the core 11 engages.

When the first section 11*a* of the core 11 is screwed into the seat 21 (so as to remain fixed inside the tubular body 16), the collar 11*c* rests on the end edge of the tubular body 16 and the second section 11*b* of the core 11, on which the blocking ring 14 is mounted in a rotating manner, protrudes from the tubular body 16. In assembled configuration of the plug 10 on the tubular body 16, therefore, the bayonet blocking ring 14 protrudes outside with respect to the tubular body 16 and is mobile in rotation with respect to it (since it is mobile in rotation with respect to the core 11).

The fixing means for fixing the tubular body 16 to the panel 18 comprise a flange 22 which protrudes jutting from the outer lateral surface of the tubular body 16 and a locking ring 23 which can be locked on the tubular body 16, in which, considering the plug 10 in mounting conditions on the panel 18, the latter remains clamped between the flange 22 and the locking ring 23.

In greater detail, the flange 22 is obtained at the second end of the tubular body 16 opposite the first end at which the seat 21 is defined and abuts against the face of the panel 18 opposite with respect to that at which the electric contacts 12 can be accessed and that, in the case in which the panel 18 is a wall of a box-shaped body, faces the inside of the latter.

The locking ring 23 screws onto a threaded portion 24 of the tubular body 16 (also in this case, in the attached figures the threading is not shown for the sake of simplicity).

In the mounting operations of the tubular body 16 with the plug 10 (in turn consisting of the assembly of the core 11 and of the bayonet blocking ring 14) housed and supported in it—on the panel 18, in particular in the case in which the latter is a wall of a box-shaped body which is necessary to connect to the receptacle 13 with a precise orientation, it is suitable to hold the tubular body 16 in the desired orientation and then fix this orientation through blocking members, for example using dowels, gluing or other systems that are suitable for preventing the relative rotation of the tubular body 16 with respect to the panel 18.

In the embodiment represented in the attached figures, the manoeuvring means 19 comprise a manoeuvring arm 25 which extends from the outer lateral surface of a manoeuvring ring 26 that is mounted in a fixedly attached manner onto the bayonet blocking ring 14 so as to form a single body with it.

In the embodiment represented in the attached figures, the manoeuvring ring 26 is formed by a ring that is interrupted by at least one slit. At the ends of the ring, defined by such a slit, there are corresponding holes 27 in which a bolt 28 is inserted through which the manoeuvring ring 26 is locked on the bayonet blocking ring 14.

However, alternative embodiments are not excluded, wherein the manoeuvring means 19 and, in particular, the manoeuvring arm 25 and/or the manoeuvring ring 26 is obtained in a single piece with the bayonet blocking ring 14 or in which the manoeuvring ring 26 is fixed to the bayonet blocking ring 14 with fixing means that are different from those that have been represented.

However, the embodiment represented in the attached figures, in which the manoeuvring arm 25 is obtained on an element (the manoeuvring ring 26) obtained on the bayonet blocking ring 14, is particularly advantageous in terms of simplicity and of production costs, since it makes it possible to use plugs 10 that are already available on the market, without requiring them to be modified in any way.

Advantageously, the manoeuvring arm 25 is provided with a gripping portion 25' for the user.

The manoeuvring arm 25 extends along a direction that is radial with respect to the manoeuvring ring 26 and, therefore, to the bayonet blocking ring 14 onto which the latter is locked—acting as a lever for the application, by a user, of a twisting moment that is suitable for rotating the bayonet blocking ring 14 during the operations of connection of the plug 10 to the receptacle 13.

The manoeuvring arm 25, moreover, makes it possible for the locking manoeuvres of the bayonet blocking ring 14 on the receptacle 13 to be easier, in particular also in the case in which both the plug 10, and the receptacle 13 are mounted on a panel 18, 18' respectively of a first box-shaped body 180 and of a second box-shaped body 180', the bulk of which could make the space between the respective mutually facing panels 18, 18' narrow and difficult to reach.

According to the present invention, moreover, a stop member 29 is provided for stopping the relative rotation of the bayonet blocking ring 14 itself with respect to the tubular body 16, said stop member being suitable for cooperating with a pair of end-strokes which are defined in the panel 18 and that delimit the stroke in rotation of the bayonet blocking ring 14 between the engagement position (closed) and the disengagement position (open) with the blocking elements 15 that are provided on the receptacle 13.

The stop member 29 is for example made up of a pin that, in the embodiment represented in the attached figures, is fixed to the face of the manoeuvring ring 26 facing towards the panel 18 and that is inserted in a guiding seat 30 that is obtained in the panel 18 itself.

However, alternative embodiments are not excluded, wherein the stop member 29 is obtained directly on the bayonet blocking ring 14 in the form of a protrusion or the like.

The guiding seat 30 is circular arc-shaped and is made up of a recess that is obtained in the face of the panel 18 on which the manoeuvring ring 26 rests and surrounds a portion of the opening 17. The end surfaces 30*a*, 30*b* of such a recess define the two end-strokes on which the stop member 29 abuts.

With reference to the attached figures, when the stop member 29 abuts against the surface 30*a*, the bayonet blocking ring 14 is in the disengagement position; when, on the other hand, the stop member 29 abuts against the surface 30*b*, the bayonet blocking ring 14 is in the engagement position with the blocking elements 15.

Advantageously, visualization means are provided for visualising the engagement position and the disengagement position and which can be made up of indications obtained in the manoeuvring ring 26 and/or in the bayonet blocking ring 14 and/or in the panel 18.

FIGS. 4A to 4E show the steps for mounting a plug 10 with a mounting assembly 100 according to the present invention on a panel 18 of a first box-shaped body 180 which is made up of two semi-portions 180*a*, 180*b* that can be coupled with one another, in which the panel 18 constitutes a wall of one of such semi-portions 180*a*.

The panel 18 has a through opening 17 in which the tubular body 16 in which the plug 10 has been pre-emptively mounted (made up of the assembly of the core 11 and of the bayonet blocking ring 14) can be inserted.

After having inserted the tubular body 16 in the opening 17 so that the flange 22 abuts against the face of the panel 18 facing inwards with respect to the first box-shaped body 180 (semi-portion 180*a*) and the bayonet blocking ring 14 at least partially protrudes from the opposite face of the panel 18, the locking ring 23 is locked on the tubular body 16.

In such a way, the panel 18 is locked between the flange 22 and the locking ring 23.

The manoeuvring ring 26 is then mounted and locked, by means of the bolt 28 on the bayonet blocking ring 14 forming a single body with it without the possibility of relative motion of either rotation or axial sliding.

The stop member 29 is inserted in the respective seat 30 of the panel 18.

The manoeuvring arm 25 is advantageously sized so as to be able to project, at least with the gripping portion 25', from the perimeter of the panel 18.

The core 11 can be connected to an electric-electronic device D, only schematically represented in FIG. 1, of the type for example of a power supply battery and/or a control and driving unit and/or a unit for transmitting data or combinations thereof.

The electric-electronic device D is housed in the first box-shaped body 180.

Figure 4A:
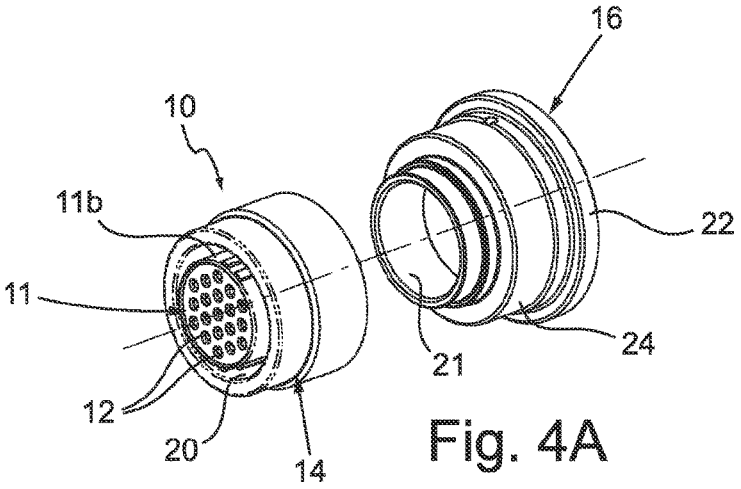
FIGS. 4A to 4E show, in sequence, the assembly steps of a plug of a bayonet circular connector on a wall of a box-shaped body with a mounting assembly according to the present invention so as to obtain a mounting arrangement according to the present invention.
Figure 4B:
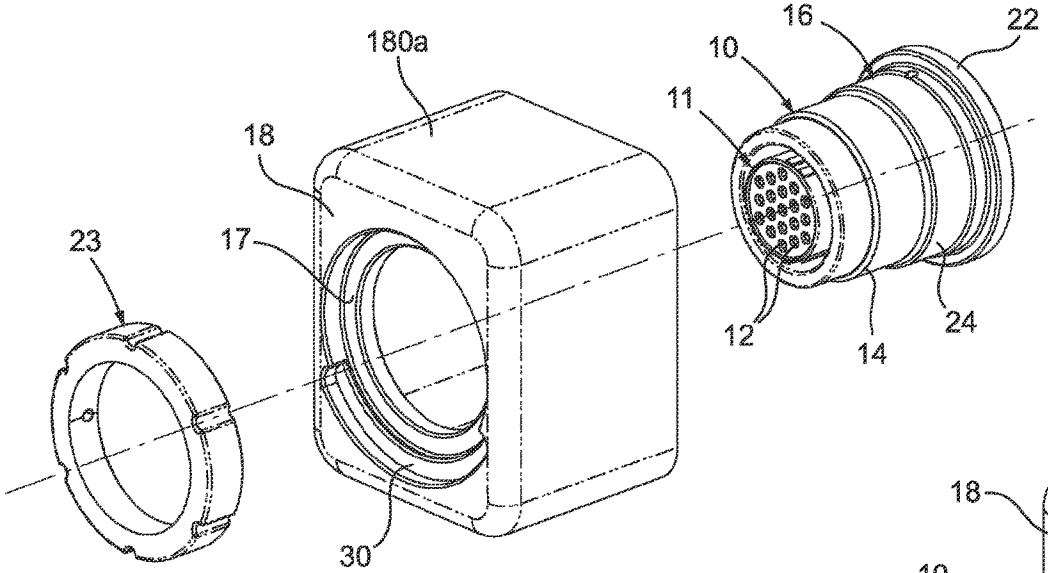
Figure 4C:
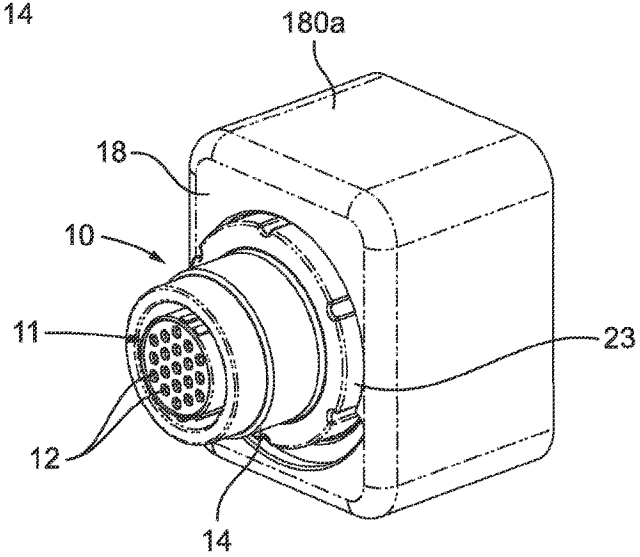
Figure 4D:
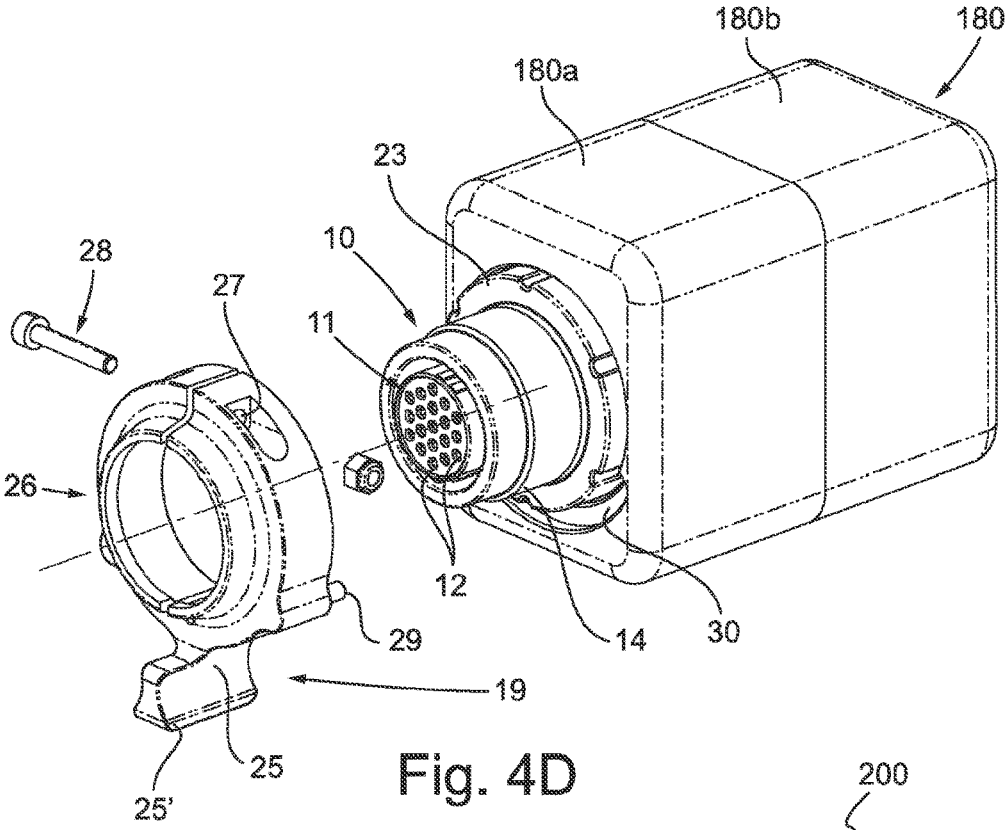
Figure 4E:
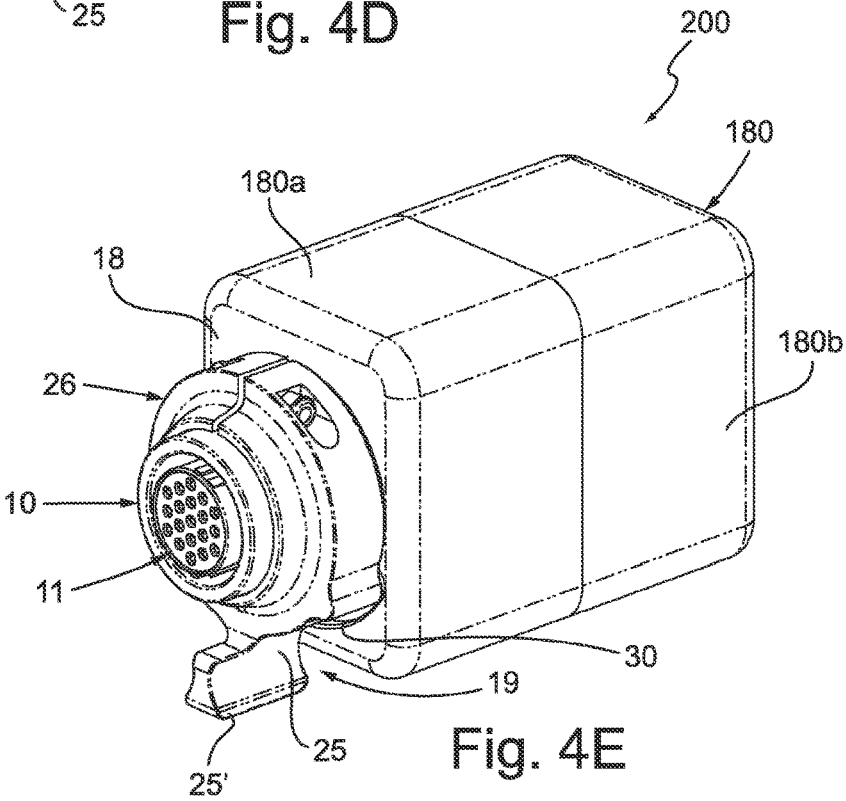

The mounting arrangement thus obtained and wholly indicated with reference numeral 200 in FIGS. 1 and 4E can be connected to a receptacle 13 of a bayonet circular connector.

Figure 5A:
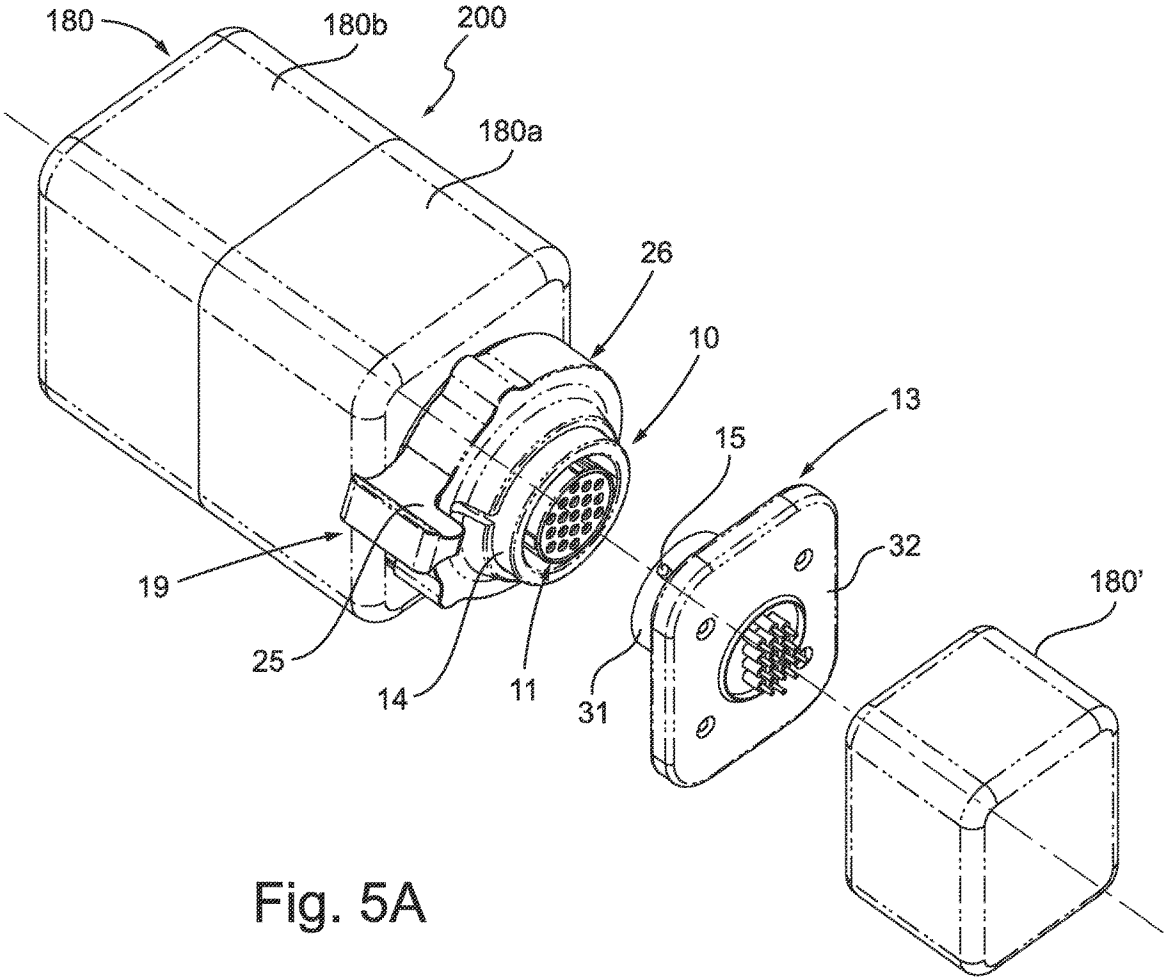
FIGS. 5A and 5B show the connection steps of a mounting arrangement according to the present invention on a bayonet circular connector receptacle that is in turn mounted on a box-shaped body.
Figure 5B:
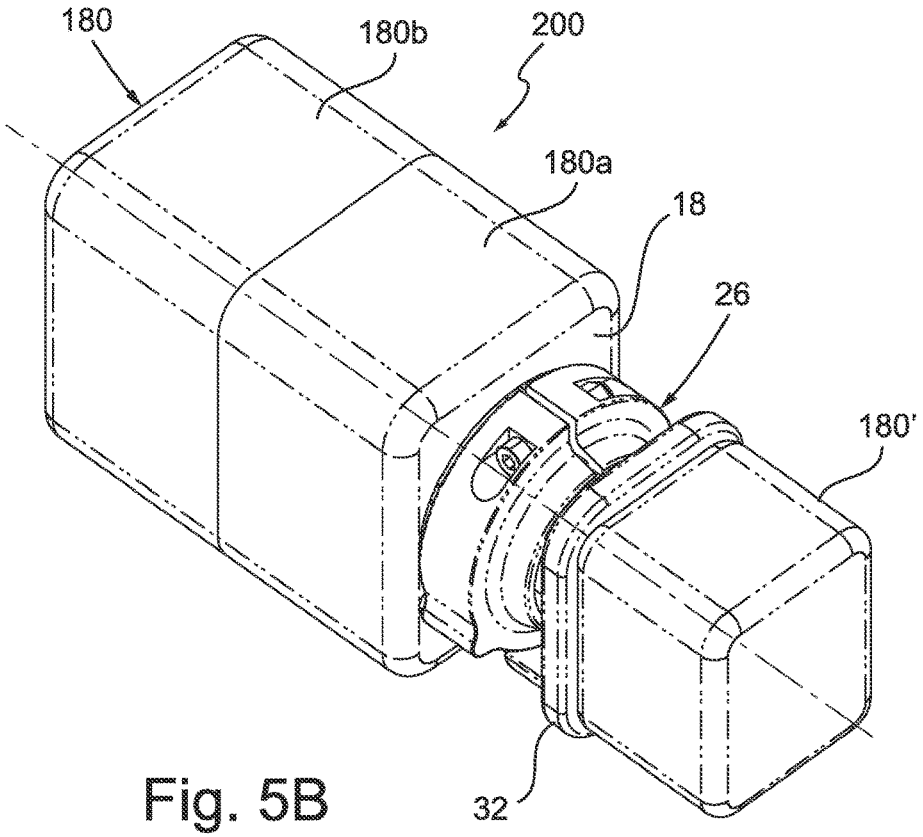
Figure 6:
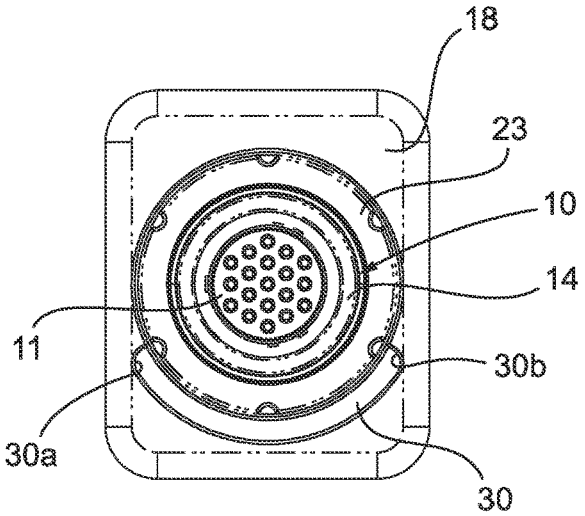
FIG. 6 is a front schematic view of FIG. 4D.

The receptacle 13, of the per se known type, is provided with a containment support 31 that is provided with a flange 32 for connecting to the wall of a second box-shaped body 180', only schematically represented in FIGS. 5A and 5B. In particular, the second box-shaped body 180' contains, in turn, a second electric-electronic device, like for example a measuring device, to be connected to the one contained inside the first box-shaped body 180.

FIGS. 5A and 5B show the mounting arrangement 200 of a plug 10 that is mounted on a first box-shaped body 180 containing a first electric-electronic device D that is connected to the core 11 thereof.

Such a mounting arrangement 200 can be mounted directly on a complementary receptacle 13, which in turn is mounted on a second box-shaped body 180' containing a second electric-electronic device to be connected to the first one.

The mounting assembly of a plug of a bayonet circular connector according to the present invention has the advantage of allowing a plug of a bayonet circular connector to be mounted directly on a panel or on a wall, in particular a panel or a wall of a containment box-shaped body of an electric or electronic device, in a manner that is simple, safe and easy to manoeuvre and control by a user also during the steps for connecting to a corresponding receptacle.

The mounting arrangement of a plug of a bayonet circular connector on a panel or a wall of a containment box-shaped body of an electric-electronic device according to the present invention has the advantage of allowing the latter to be directly connected to the receptacle without the interposition of cables.

The mounting assembly and the mounting arrangement of a plug of a bayonet circular connector according to the present invention on a panel or on a wall of a containment box-shaped body according to the present invention thus conceived can undergo numerous modifications and variants, all covered in the invention, moreover, all the details can be replaced by technically equivalent elements. In practice the materials used, as well as the dimensions, can be any according to the technical requirements.

The invention claimed is:

1. A mounting assembly (100) operatively associated with a plug (10) of a bayonet circular connector, said plug (10) including a circular core (11) which supports a plurality of electric contacts (12) engageable with corresponding complementary electrical contacts of a receptacle (13) of said bayonet circular connector and a bayonet blocking ring (14) which is mounted in a rotating manner on said circular core (11) said bayonet blocking ring (14) being suitable for cooperating with blocking elements (15) arranged in said receptacle (13), said mounting assembly (100) comprising:

a tubular body (16) which supports said circular core (11), said tubular body (16) having opposite ends and being insertable in an opening (17) of a panel (18) of a box-shaped body, fixing means configured for fixing said tubular body (16) directly on the panel (18) of a box-shaped body, wherein said fixing means comprise a flange (22) which protrudes outwardly from an outer lateral surface of said tubular body (16) and a locking ring (23) lockable on said tubular body (16), wherein, when said plug (10) is mounted on said panel (18) of said box-shaped body and said panel (18) of said box-shaped body is clamped between said flange (22) and said locking ring (23), said bayonet blocking ring (14) partially protrudes from a face of said panel (18) of said box-shaped body and manoeuvring means (19) configured for manoeuvring said bayonet blocking ring (14) wherein said manoeuvring means are integrally attached to said bayonet blocking ring (14).

2. The mounting assembly (100) according to claim 1, wherein said tubular body (16) is open at said opposite ends and has, at one first end of said opposite ends, a seat (20) for housing a first section (11*a*) of said core (11), wherein said first section (11*a*) of said core (11) is fixable in said seat (20) and wherein said core (11) has a second section (11*b*) which extends from said first section (11*a*) in order to protrude from said tubular body (16) and whereon said bayonet blocking ring (14) is mounted in a rotating manner.

3. The mounting assembly (100) according to claim 1, wherein said fixing means comprise blocking members for blocking relative rotation of said tubular body (16) with respect to said panel (18).

4. The mounting assembly (100) according to claim 1, wherein said manoeuvring means (19) comprise a manoeuvring arm (25) which extends from an outer lateral surface of said bayonet blocking ring (14) or from a manoeuvring ring (26) mounted in a fixed manner on said bayonet blocking ring (14) and which is provided with a gripping portion (25').

5. The mounting assembly (100) according to claim 4, wherein said mounting assembly comprises said manoeuvring ring (26) from the outer lateral surface of which said manoeuvring arm (25) extends and wherein said stop member is mounted (29).

6. The mounting assembly (100) according to claim 1, wherein said mounting assembly comprises a stop member (29) for stopping the relative rotation of said bayonet blocking ring (14) with respect to said tubular body (16) and suitable for cooperating with a pair of end-strokes defined in said panel (18) and delimiting a stroke in rotation of said bayonet blocking ring (14) between an engagement position and disengagement with said blocking elements of said receptacle.

7. The mounting assembly (100) according to claim 6, wherein said mounting assembly comprises visualization means for visualizing said engagement position and said disengagement position.

* * * * *